United States Patent [19]

Sage

[11] 4,416,310

[45] Nov. 22, 1983

[54] DOUBLE-LIFT JACQUARD MECHANISM

[75] Inventor: Paul Sage, Lyons, France

[73] Assignee: Verdol S.A., Caluire, France

[21] Appl. No.: 309,970

[22] PCT Filed: Feb. 17, 1981

[86] PCT No.: PCT/FR81/00019

§ 371 Date: Oct. 5, 1981

§ 102(e) Date: Oct. 5, 1981

[87] PCT Pub. No.: WO81/02434

PCT Pub. Date: Sep. 3, 1981

[30] Foreign Application Priority Data

Feb. 22, 1980 [FR] France ..... 80 04281

[51] Int. Cl.[3] ..... D03C 3/20; D03C 3/06

[52] U.S. Cl. ..... 139/59; 139/65; 139/455

[58] Field of Search ..... 139/59, 55.1, 455, 65, 139/85, 319, 68

[56] References Cited

U.S. PATENT DOCUMENTS

| | | | |
|---|---|---|---|
| 1,214,449 | 1/1917 | Fuchs | 139/68 |
| 1,721,787 | 7/1929 | Nakanishi | 139/319 |

FOREIGN PATENT DOCUMENTS

| | | | |
|---|---|---|---|
| 1906109 | 8/1970 | Fed. Rep. of Germany . | |
| 2119053 | 12/1972 | Fed. Rep. of Germany . | |
| 2533763 | 11/1976 | Fed. Rep. of Germany | 139/59 |
| 7002 | 5/1851 | France | 139/59 |
| 1554517 | 12/1968 | France . | |
| 8217 | of 1896 | United Kingdom | 139/319 |
| 2047755 | 12/1980 | United Kingdom | 139/65 |

*Primary Examiner*—James Kee Chi

*Attorney, Agent, or Firm*—Dowell & Dowell

[57] ABSTRACT

A double-lift Jacquard mechanism in which the heddles are connected to resilient metal blades which pass through first and second plates that are reciprocated transversely of the blades in opposite directions, the blades having catches thereon which are selectively engaged by bars on the first plate to raise the associated heddles and having shoes thereon which engage the second plate to lower the associated heddles when the second plate is reciprocated, and the blades being deflectable to select the engagements thereof with the plates by deflection magnets which are under the control of a pattern selecting device to determine which directions the respective blades will be moved in by the plates.

9 Claims, 12 Drawing Figures

3
3b
5
6
4
11
16
17
19
18
19a
15
9
12
10
7
13
8
14a
14
10a
20
21
11a
3a
1
2
1a
0

16
17
18
19a
19
14a
15
11
23
9
13
12
6
10
3b
4
11a
5
7
8
14
21
10a
11a
6
5
6
7
21
23a
20
10
3
11a
7
10a
23a
3a
21
14a
14
20
12
13
16
15
18
19a
19
1
1a
2
2
1a

DOUBLE-LIFT JACQUARD MECHANISM

The present invention relates to improvements of shed opening devices for open-shed Jacquard machines connected for weaving fancy cloths and more particularly, though not exclusively, for silk fabrics.

It is known that in order to weave fabrics with very large patterns and with a high density of warp threads, such as pictures, tapestry works or other drawings, manual looms have hitherto been used. This manufacturing process obviously entails considerable labor costs and very long manufacturing times.

If it is desired to manufacture such fabrics on mechanized looms, it is necessary to provide a large number of conventional or Verdol Jacquard machines capable of opening the shed to permit passage of the weft threads. If it is contemplated to manufacture a fabric comprising 10,000 warp threads for a loom having a width of 140 cm, the actuation of the heddles adapted to open the shed will have to be effected by a number of Jacquard machines varying between 8 and 10. It is easily understood that such a number of these devices is not compatible with the space available above a loom of 140 cm in width and that in addition the synchronous drive of these machines could only be obtained at the cost of an intricate installation. Finally the cost of such a mechanism would be prohibitive.

The improvements which form the object of the present invention aim at providing a warp threads actuating device on a loom with a view to operate the opening of the shed starting from an information derived from a perforated paper, a magnetic band or the like, the cumbersomeness of which may be reduced in such manner that it may control a very large number of heddles vertically disposed near each other, its manufacturing cost remaining rather low.

The invention further concerns a device of the kind described which may be divided into modules separable from each other in such manner that if the density of the warp threads of the fabric is reduced it may be possible to eliminate a certain number of modules without having to disassemble the whole harness. When for instance one of every two modules is disassembled or at least eliminated, the heddles do not all have a vertical orientation, they are on the contrary slightly oblique, but without this inclination having an unfavorable effect with respect to the shed at the open position thereof.

In accordance with the invention, the blades associated with the heddles pass through a first plate provided with small bars and through a second plate having apertures, these blades each carrying a shoe and a catch, this shoe always resting against the second plate in such manner that the reciprocatory translation of this latter causes the downward motion of the heddles, except when the blade is actuated for upward displacement by the corresponding small bar of the first plate. This occurs when the small bars of the first plate engage the catches of the selected blades when the first plate is reciprocated in order to raise the selected heddles. Blade deflecting means are further provided to cause the small bars to escape the blades which have not been selected.

Since the fancy fabrics which it is contemplated to manufacture in a mechanized manner are generally made of delicate threads and of delicate materials such as silk, it is necessary to reduce to a maximum degree the tension of these threads at the time of the opening of the shed in order to avoid permanent deformations. For this purpose, the double-lift raising-and-lowering system is used, that is to say a sheet of warp threads is raised while the other threads are lowered through the same distance equal to half the height of the shed. It is thus possible to obtain fancy fabrics of high quality owing to the fact that, the lowering and raising strokes being equal, all the threads undergo the same tension.

The annexed drawings, given by way of example, will permit a better understanding of the invention, of the characteristics which it possesses and of the advantages which it may afford:

Figure 1:
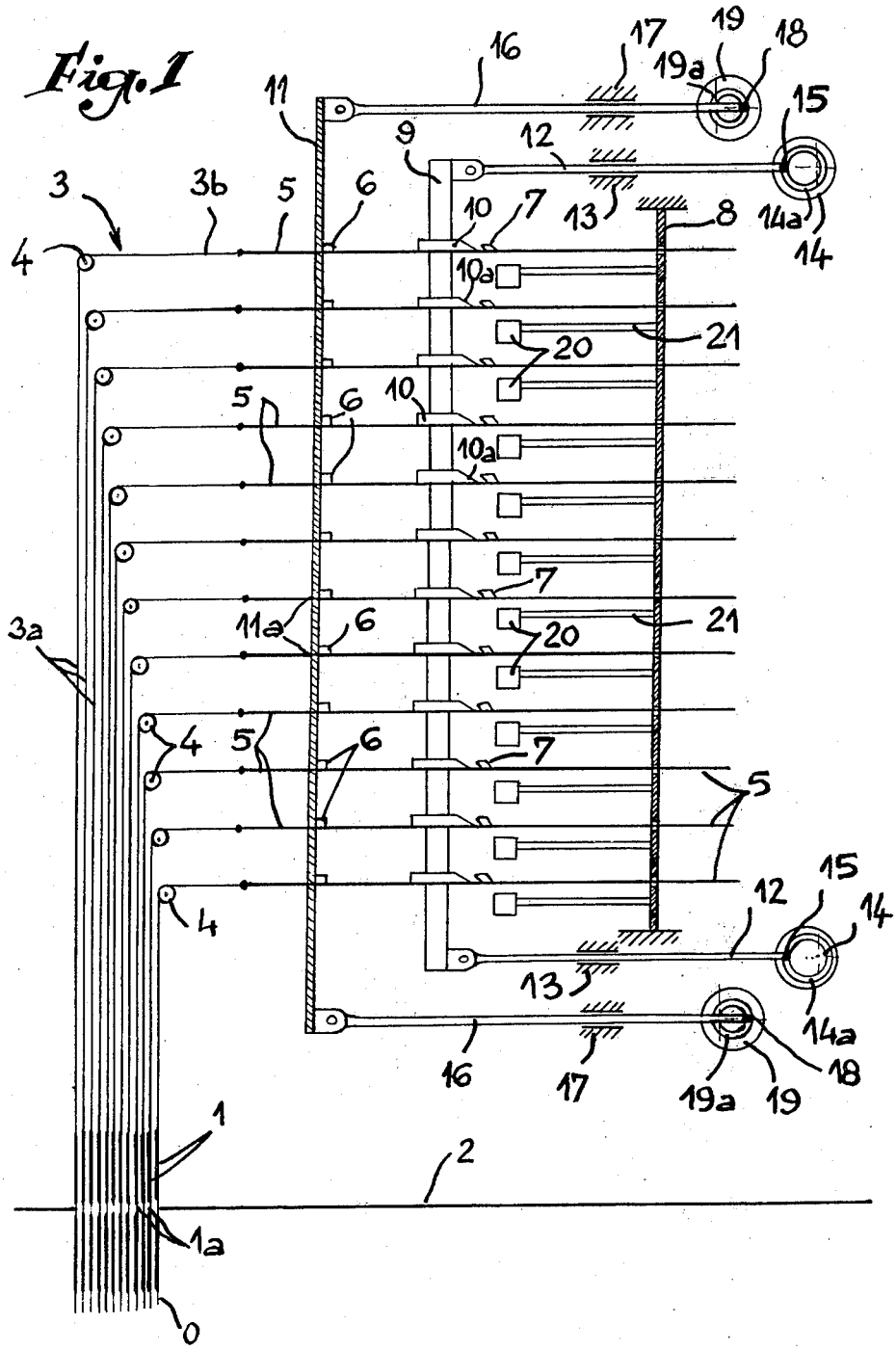
FIG. 1 is a diagrammatical view of a controlling device according to the invention.

There has been illustrated in FIG. 1 a device according to the invention shown in the closed position of the shed. This device comprises a harness formed of a number of heddles 1, through the eyelets 1*a* of each of which is passed a warp thread 2. The upper end of each of heddles 1 is associated with a harness string 3, while its lower end is connected with the frame by means of resilient cords referenced 0 or of like devices. As illustrated in the figure under consideration, the harness strings include vertical portions 3*a* and horizontal portions 3*b* due to the presence of deviating pulleys 4. The end of the horizontal portion 3*b* of each harness string is associated with a resilient metallic blade 5 which carries a shoe 6 and a catch 7. The end of each blade opposed to the end connected with the harness string is free, but it is supported by a perforated sheet 8 through which the blades slide freely. Each blade further passes through a first plate 9 provided with small bars 10 with the blades resting against the underside of the bars. These blades also pass freely through a second plate 11 at apertures 11*a*. As will be better explained below, the first plate is used to raise the heddles 1, while the second 11 is intended to permit their lowering. It is noted that the first plate 9 comprises actuating rods 12 guided by bearings 13 which are pivoted to the said plate at one of their ends, while the opposite end is associated with a cam 14 by means of a roller 15 which runs in a groove 14*a* of this cam. This latter is arranged in such manner that when it rotates it causes a displacement x of plate 9 towards the right in FIG. 1.

In a similar manner the plate 11 is associated with actuating rods 16 which pass through guiding devices 17 and one end of which is pivoted to the plate under consideration while the other end carries a roller 18 which cooperates with a groove 19*a* provided in a cam 19. Rotation of this latter has for its result a translation y of plate 11 towards the right for reasons which will be better explained below. In an advantageous manner and for the reasons above explained $x=y$ is selected.

It is noted that the sheet 8 supports electromagnets 20 disposed at the end of rectilinear supports 21.

The arrangement is such that at the outset each blade is given a slight upwardly directed curvature in such manner that it resiliently rests against the lower side of each small bar 10.

It is observed that in FIG. 1 the shed is closed, that is to say that all the eyelets 1*a* of the heddles 1 are situated in a same horizontal plane, the various warp threads 2 being all contained in the said plane. Owing to the resilient downward bias of the heddles the shoes 6 rest against the right-hand side of the second plate 11 owing to the fact that they have a transverse section greater than that of the apertures 11*a* of this plate through which the blades pass. Catches 7 are then disposed somewhat on the right of the bevelled side 10*a* of each small bar 10.

Figure 3:
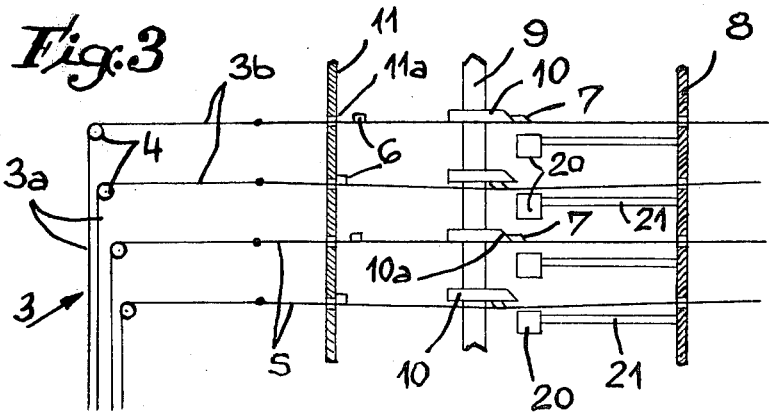

The operation results from the preceeding explanations:

The application of current to a number of electromagnets 20 takes place according to a selection device which is obtained either from a perforated paper, or from a magnetic band or any other system. As has been illustrated in FIG. 1, the blades 5 which correspond to the electromagnets 20 concerned are deformed and deflected downwardly in such manner that their catches 7 are now disposed below the small bar 10 of plate 9. On the contrary the blades which correspond to the electromagnets receiving no current remain in position. The synchronized rotation of cams 14 and 19 causes, as above explained, the reciprocatory displacement of plates 9 and 11 respectively towards the right and towards the left. It goes without saying that the heddles corresponding to the blades which have been attracted by the electromagnets are not moved by the displacement of plate 9. The translation of plate 11 ensures the downward displacement of these heddles owing to the action of the resilient cords 0 since the shoes of the blades remain in contact with this plate during the translation under consideration. On the contrary the blades which have not been attracted by the electromagnets are displaced towards the right by the cooperation of the bevelled ends 10*a* of bars 10 with catches 7. In order to leave the electromagnets under voltage during the smallest possible time, current supply is automatically cut off as soon as plate 9 has initiated its displacement towards the right so that when this supply has ceased, the catch 7 is not caught by this bar but comes to bear against the lower side thereof as illustrated in FIG. 3.

Figure 4:
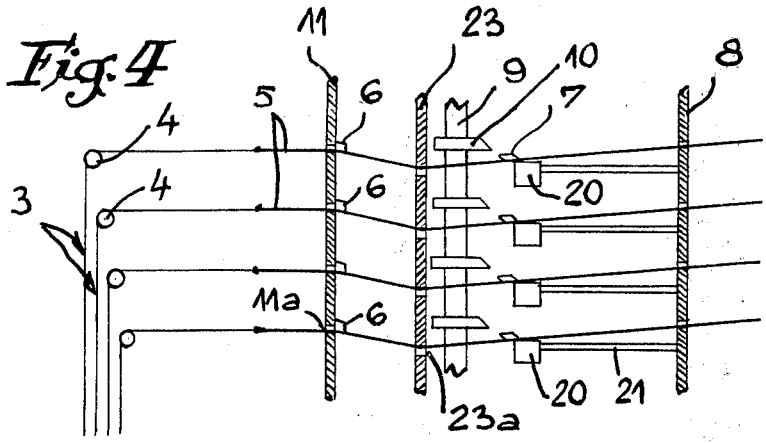
Figure 5:
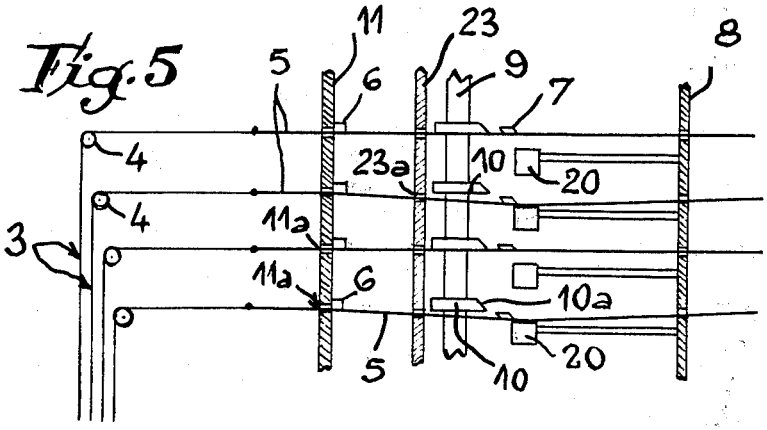
Figure 6:
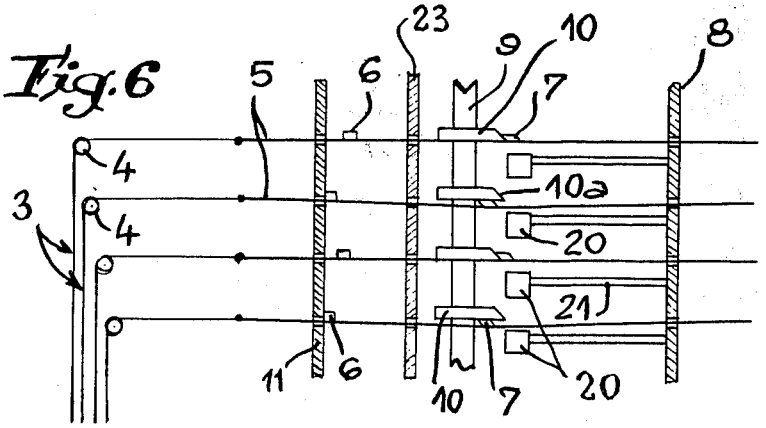

In order to improve the general operation of the unit there is provided, as illustrated in FIGS. 4 to 6, that all the blades 5 pass through the oblong holes 23*a* of an auxiliary plate 23, the height of these holes being substantially greater than the displacement in height of the blades from their normal position to a deflected position at which they are applied against electromagnets 20. FIG. 4 illustrates the function of plate 23. Just before the time at which electromagnets are supplied with current, the plate's lowering is effected by means of a mechanism not illustrated, in such manner that the upper edge of holes 23*a* acts on all the blades to bring them into contact with the electromagnets. When some of these latter receive current the corresponding blades are retained by the electromagnets while the other blades are merely resting against them. Plate 23 is thereafter returned upwardly so that the blades which are not retained by the electromagnets return to the position normal illustrated in FIG. 5. Owing to plate 23 it is possible to reduce the power of the electromagnets which no longer have to achieve the attraction of the blades, but only to retain them. This besides constitutes an important safety factor.

Figure 7:
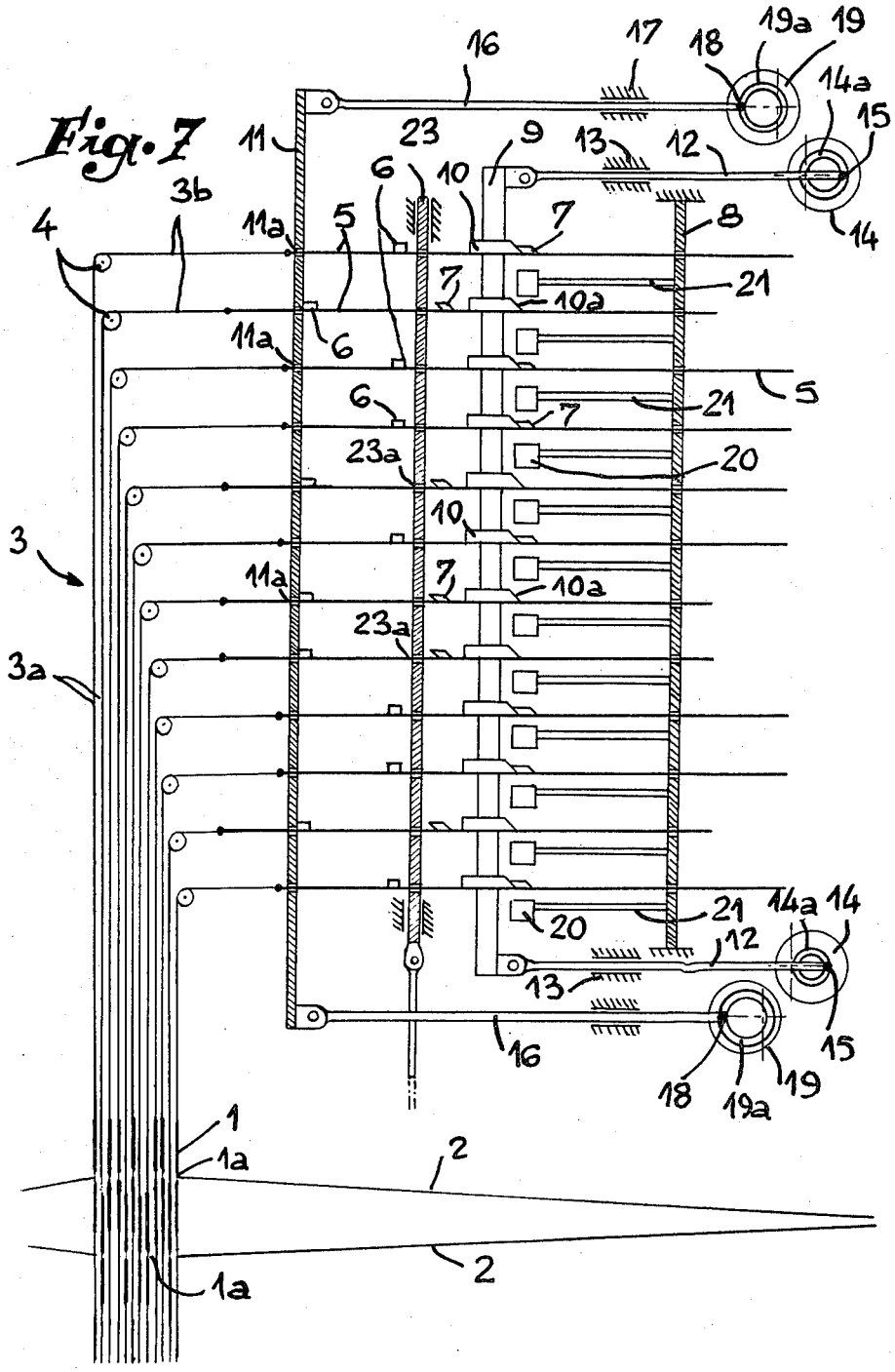
FIG. 7 is a view similar to that of FIG. 1 but showing the device at the open shed position.

Due to their oppositely directed motions the two plates 9 and 11 effect the opening of the shed in accordance with the selection which has been established, as illustrated in FIG. 7, in order to permit insertion of the weft. They afterwards resume their initial positions illustrated in FIG. 1, the shed then being again closed. The cycle is repeated each time with the defined selection which corresponds to the patterns to be obtained. It is observed that plate 23 has been shown in FIG. 7.

Figure 8:
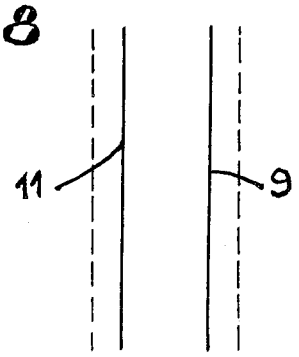
FIGS. 8 and 9 illustrate various positions of the plates for respectively levelled and oblique sheds.
Figure 9:
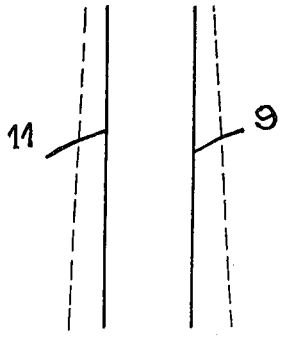
Figure 2:
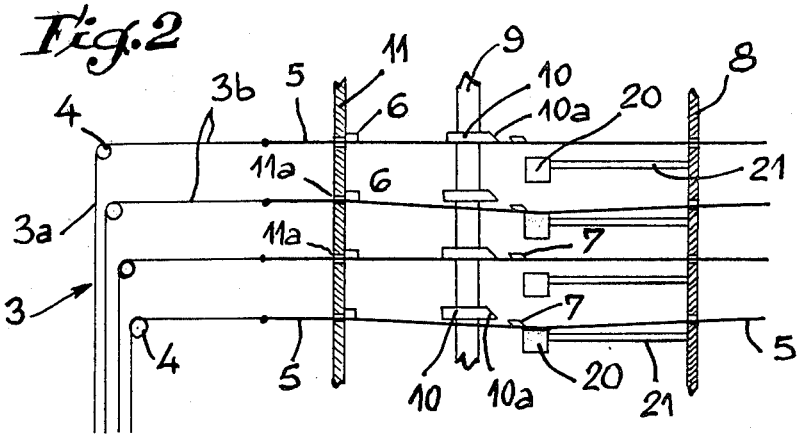
FIGS. 2 to 6 illustrate the main operating steps of the device according to the invention including those which correspond to a preferred modified embodiment.

The heddle raising plate 9 and the heddle lowering plate 11 which ensure the motion of the resilient blades may be displaced in parallel relation to themselves, as illustrated in FIG. 8 with a veiw to obtain a levelled shed, or they may be situated at their extreme positions as illustrated in FIG. 9, which results in an oblique shed.

The stroke of the plates may also be modified to obtain variations in the height of the shed, for instance by changing cams 14 and 19.

In the illustrated examples which have been heretofore mentionned the plates have been disposed vertically for reasons concerning an easy access, since this arrangement permits the user to replace easily a defective blade or harness string without having to disassemble the whole harness. It is obvious that the plates in question could be made horizontal, this position having for its result the elmination of pulleys 4.

As indicated at the beginning ot this specification, the device could be divided, that is, plates 9, 11, plate 23 and sheet 8 would be made in the form of modules of small width mounted on slides. It would then be possible to eliminate some modules and the corresponding portion of the harness when the density of the warp threads is reduced.

Figure 10:
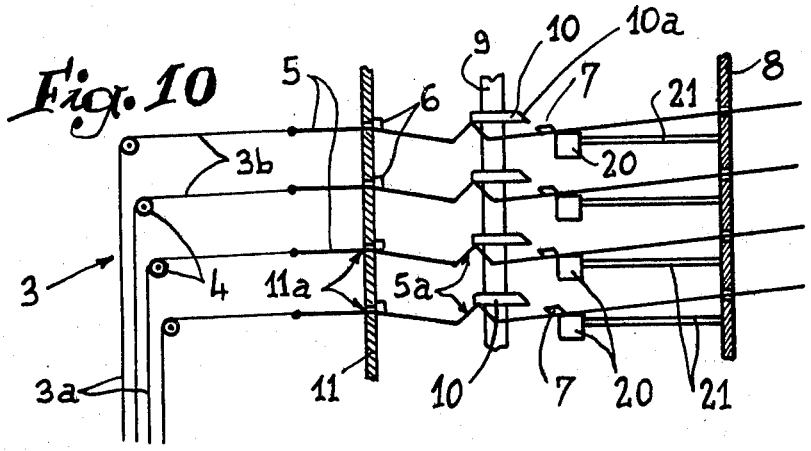
FIGS. 10 to 12 show alternative embodiments of the invention.
Figure 11:
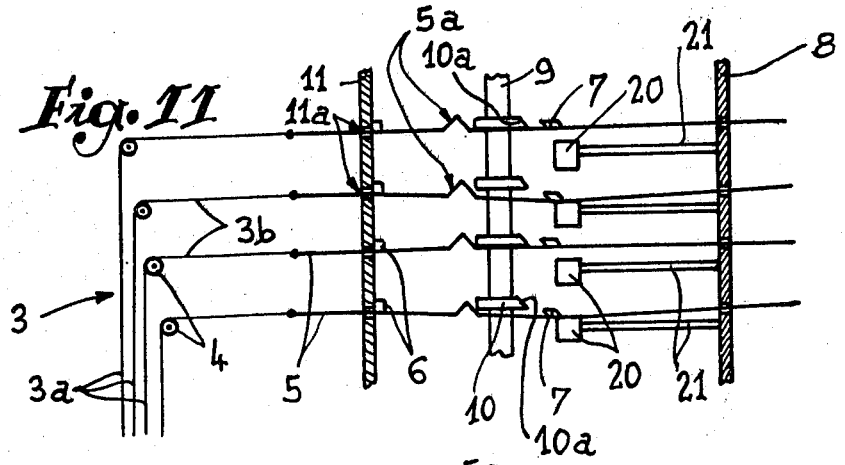
Figure 12:
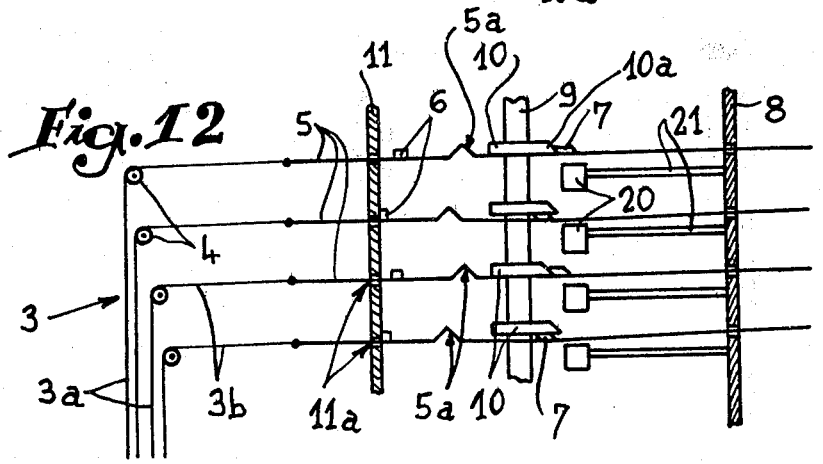

As illustrated in FIGS. 10 to 12, and in order to decrease the number of parts in motion, it would be possible to eliminate plate 23 illustrated in FIGS. 4 to 6, and to achieve the application of blades 5 against electromagnets 20 by a much simpler means. For this purpose, as illustrated in FIGS. 10 to 12, each blade is formed with a projection 5*a* which bears against the corresponding small bar 10 of the first plate 9. In this manner when plate 11 is at its extreme position (towards the right in the figures under consideration) it brings the boss 5*a* into contact with the bar 10 to apply the blade against the electromagnet 20, since the said plate moves the shoe 6 towards the right.

Due to this arrangement much higher speeds may be obtained without any vibration being generated.

This invention teaches a device for opening the warp shed in a loom, which permits of obtaining a fancy fabric with very fine patterns and which includes a remarkable reliability.

It should besides be understood that the preceding description has only been given by way of example and that it in no way limits the scope of the invention from which one would not depart by replacing the structural details described by any other equivalents.

I claim:

1. An improved Jacquard mechanism operative to open the shed of warp threads in a loom by double-lift displacements of heddles according to information taken from a pattern selecting device, the mechanism comprising:

(a) a first plate and a second plate reciprocated by the loom toward and away from each other, the plates having apertures therethrough which are mutually aligned;

(b) multiple resilient blades associated respectively with the heddles, the blades passing transversely of the plates through their apertures, and the blades being respectively connected at one end with corresponding heddles and operative to displace the heddles;

(c) a shoe fixed to each blade between the first and second plates and operative to abut the second plate and support the blades against the second plate whereby to lower heddles associated with said blades as the second plate is reciprocated;

(d) a catch on each blade, and a bar fixed transversely through the first plate at each aperture and disposed parallel to the blade thereat and having a catch-engaging end disposed to abut the catch of the adjacent blade in the blade's normal position, whereby reciprocation in the first plate engages the bars with the catches and displaces the associated heddles to raised positions; and (e) blade deflecting means associated with each blade, each deflecting means being under the control of a pattern selecting device and operative thereby to deflect the blade at the beginning of reciprocation of the first plate from the blade's normal position to a deflected position in which the catch can pass by said end of the bar and through said first plate, whereby a deflected bar is displaced only by reciprocation of the second plate to lower its associated heddle.

2. A mechanism as claimed in claim 1, wherein said blades are made of flexible metal and said blade deflecting means comprise electromagnets adjacent to each blade and energised by the pattern selecting device to deflect the associated blade to its deflected position.

3. A mechanism as claimed in claim 2, wherein the electromagnets are de-energised by the pattern selecting device to release the blades just after the bars of the first plate have engaged the catches of the undeflected blades.

4. A mechanism as claimed in claim 2, wherein an auxiliary plate is located adjacent to the first plate and has apertures therethrough to receive the blades, the auxiliary plate being operated by the loom synchronously with the beginning of the reciprocation of the first and second plates to deflect all the blades briefly toward the electromagnets, whereby to reduce the maximum deflecting force when the electromagnets must achieve when energised.

5. A mechanism as claimed in claim 1, wherein the other ends of the blades are supported and guided with respect to the first and second plates by a perforated sheet located adjacent to said plates and supporting said blade deflecting means.

6. A mechanism as claimed in claim 5, wherein each blade has a projection comprising part of said blade deflecting means, each projection being located between the first and second plates and operative to briefly engage the first plate at the beginning of its reciprocation to deflect all the blades briefly toward the electromagnets, whereby to reduce the maximum deflecting force which the electromagnets must achieve when energised.

7. A mechanism as claimed in claim 1, wherein the first and second blades are reciprocated in non-parallel manner with respect to each other, whereby to perform oblique opening of the shed.

8. A mechanism as claimed in claim 1, wherein the heddles are displaced vertically and the blades pass horizontally through the plates and are connected by strings passed over pulleys to connect one end of each blade with a corresponding heddle.

9. A mechanism as claimed in claim 1, wherein said plates and blades are grouped into separate modules wherein the modules are individually attachable to the loom or removable therefrom according the number of warp threads to be opened.

* * * * *